US007322300B2

(12) United States Patent
Caeton

(10) Patent No.: US 7,322,300 B2
(45) Date of Patent: Jan. 29, 2008

(54) SPACE SAVING TABLE

(76) Inventor: Jeremy Daniel Caeton, 1285 W. Campbell Ave., #4, Campbell, CA (US) 95008

( * ) Notice: Subject to any disclaimer, the term of this patent is extended or adjusted under 35 U.S.C. 154(b) by 0 days.

(21) Appl. No.: 11/269,012

(22) Filed: Nov. 8, 2005

(65) Prior Publication Data

US 2006/0118011 A1 Jun. 8, 2006

Related U.S. Application Data

(60) Provisional application No. 60/633,572, filed on Dec. 6, 2004.

(51) Int. Cl.
*A47B 13/08* (2006.01)

(52) U.S. Cl. ..... 108/90; 108/50.12

(58) Field of Classification Search ..... 108/43, 108/44, 90, 50.11, 50.12, 47, 91, 92, 65, 66; 297/217.1, 188.09, 188.1
See application file for complete search history.

(56) References Cited

U.S. PATENT DOCUMENTS

| | | | | | |
|---|---|---|---|---|---|
| 297,219 | A * | 4/1884 | Anthony | 108/43 |
| 826,669 | A * | 7/1906 | Kingden | 108/90 |
| 1,462,471 | A * | 7/1923 | Alpiner | 108/43 |
| 1,851,600 | A * | 3/1932 | Stanley | 108/43 |
| 2,265,841 | A * | 12/1941 | Jankowski | 297/440.22 |
| 2,799,543 | A * | 7/1957 | Tomaselli | 108/50.12 |
| 2,945,597 | A * | 7/1960 | Romano | 108/94 |
| 3,791,314 | A * | 2/1974 | Berretta | 108/43 |
| 3,821,936 | A * | 7/1974 | Morse | 108/43 |
| 4,046,294 | A * | 9/1977 | Morin | 108/43 |
| 4,379,587 | A * | 4/1983 | Duncan | 297/188.09 |
| 4,397,246 | A * | 8/1983 | Ishida et al. | 108/55.3 |
| 4,403,806 | A * | 9/1983 | Stephen | 297/217.1 |
| 4,819,568 | A * | 4/1989 | Coffrin | 108/43 |
| 4,852,498 | A * | 8/1989 | Judd | 108/43 |
| 5,106,156 | A * | 4/1992 | Marquis | 108/43 |
| 5,335,803 | A * | 8/1994 | O'Brien et al. | 108/50.12 |
| 5,443,018 | A * | 8/1995 | Cromwell | 108/44 |
| 5,586,805 | A * | 12/1996 | Rinehart | 297/188.09 |
| 6,164,213 | A * | 12/2000 | Topps et al. | 108/43 |
| 6,662,733 | B1 * | 12/2003 | Scott | 108/43 |
| 6,745,702 | B2 * | 6/2004 | Goldberg et al. | 108/26 |
| 6,889,618 | B1 * | 5/2005 | Gromack | 108/151 |
| 7,004,082 | B2 * | 2/2006 | Yang | 108/50.12 |

FOREIGN PATENT DOCUMENTS

GB 2111827 A * 7/1983

* cited by examiner

*Primary Examiner*—Jose V. Chen
(74) *Attorney, Agent, or Firm*—Raymond M. Galasso; Galasso & Associates LP; David O. Simmons

(57) ABSTRACT

A table comprising a support for a first tabletop section having a first edge including a first recess and for a second tabletop section having a second edge including a second recess. A plurality of fasteners releasably joins the first edge to the second edge to form a tabletop when the first edge lies adjacent to the second edge to provide alignment of the first recess with the second recess to form an opening in the tabletop between the first tabletop section and the second tabletop section. The support is preferably a planter using a plurality of mounting members for releasable connection of the first tabletop section and the second tabletop section to the support or planter to secure the tabletop thereto to form the table.

16 Claims, 3 Drawing Sheets

SPACE SAVING TABLE

CROSS REFERENCE TO RELATED APPLICATIONS

This patent application claims priority to U.S. Provisional Patent Application having Ser. No. 60/633,572 filed Dec. 6, 2004 entitled "Space Saver Patio Table", having a common applicant herein and being incorporated herein in its entirety by reference.

FIELD OF THE DISCLOSURE

The disclosures made herein relate generally to space saving table structures and, more particularly, to a structure comprising a split tabletop releasably mounted on a support, such as a planter, to provide a patio table for occasional use during parties and similar events that increase the need for tabletop space.

BACKGROUND

Individuals and families spend the major part of their lives in the relative peace and seclusion of their own homes. On occasion, however, they seek the company of an extended family or friends and acquaintances, joining them in a variety of group activities. Groups assemble in a variety of locations for a number of reasons such as birthday parties, garden parties, recognition and achievement receptions and banquets and similar types of celebrations.

People who want to entertain family and friends are often limited by the space provided by their residences. During a party held at one's home, a common situation occurs in which guests migrate to different rooms in the house. Some guests congregate in a kitchen, while others choose to use the living room or den, for example. Still other guests prefer the outdoors and choose to interact with other partygoers on a patio or porch. Regardless of their venue, attendees at special events, whether standing or sitting, generally need a surface nearby upon which to place food and drinks. However, finding an unused section of a table can be difficult, especially if tables are loaded with food and drinks. Often, this becomes less of a problem when the event organizer provides occasional tables in addition to furniture permanently in place at the site of a special event.

U.S. Pat. No. 1,890,409, U.S. Pat. No. 4,315,467 and U.S. Pat. No. 4,643,103 disclose collapsible tables suitable for occasional use. Tables of this type provide extra food or beverage stations or satisfy the need for additional tabletop space for use by guests at a party or other special event. If, however, the event draws a large enough number of invited guests, there will be crowding and not enough space for extra tables. Partygoers often try to overcome lack of tabletop space by precariously balancing items of food and drink whereby accidents occur causing damage to the furnishings and furniture of a host's residence.

Planning a successful party requires tabletop space sufficient for the number of people invited to a party. A tabletop concept based on structures existing in a home requires less physical space, allows more space for guests and reduces the probability of accidental spills. Therefore, a space saver table overcoming limitations, shortcomings and/or drawbacks associated with the use of conventional occasional tables.

SUMMARY OF THE DISCLOSURE

Embodiments of a space saver patio table in accordance with the present invention increase the amount of tabletop space in patio areas, and other entertainment spaces. The use of one or more space saver patio tables allows improved use of available space and provides the opportunity to accommodate more people than usual, particularly when space is restricted. Therefore, embodiments of the present invention advantageously overcome one or more shortcomings associated with the use of conventional occasional tables.

In one embodiment of the present invention, a table comprises a support base and a first tabletop section having a first edge including a first recess. The table has a second tabletop section having a second edge including a second recess. A plurality of fasteners releasably joins the first edge to the second edge to form a tabletop when the first edge lies adjacent to the second edge to provide alignment of the first recess with the second recess to form an opening in the tabletop between the first tabletop section and the second tabletop section. The tabletop is secured to the support using a plurality of mounting members that releasably connect the first tabletop section and the second tabletop section to the support to secure the tabletop to the support to form the table.

Turning now to specific aspects of the present invention, at least one embodiment of the present invention provides a space saving patio table having a structure that includes a support base, such as a garden planter, for example. The occasional use of planters and plant pots to support tabletops provides additional surfaces on which food and drink and related items could be placed by hosts and guests during a social event.

In at least one embodiment, the present invention provides a structure comprising: a split tabletop releasably mounted on a support using a plurality of mounting members each providing connection of the split tabletop to the support base.

In at least one embodiment of the present invention, a tabletop, assembled by abutment of adjacent tabletop sections, would include an open area formed in the center of the tabletop. The open area accommodates the stem or stems of one or more plants inside a planter that acts as the base for supporting the tabletop when assembled. Assembly of the tabletop entails placing a first tabletop section on the planter adjacent and opposing a second tabletop section and, optionally, connecting the two tabletop sections with one or more fasteners.

In another embodiment of the present invention, a split tabletop is releasably mounted on a support base using a plurality of mounting members each having an engagement portion for the split table top and an engagement portion for the support to provide connection of the split tabletop to the support.

In a further embodiment of the present invention, a split tabletop uses a planter as a support and a plurality of mounting members, each having an engagement portion interacting with the split table top and an engagement portion for the planter, provides connection of the split tabletop to the planter.

These and other objects, embodiments, advantages and/or distinctions of the present invention will become readily apparent upon further review of the following specification, associated drawings and appended claims.

BRIEF DESCRIPTION OF THE DRAWINGS

The invention will be described in greater detail, referring to several embodiments that provide clarification by way of example only and with reference to the attached drawings, in which.

DETAILED DESCRIPTION OF THE DRAWING FIGURES

Figure 1:
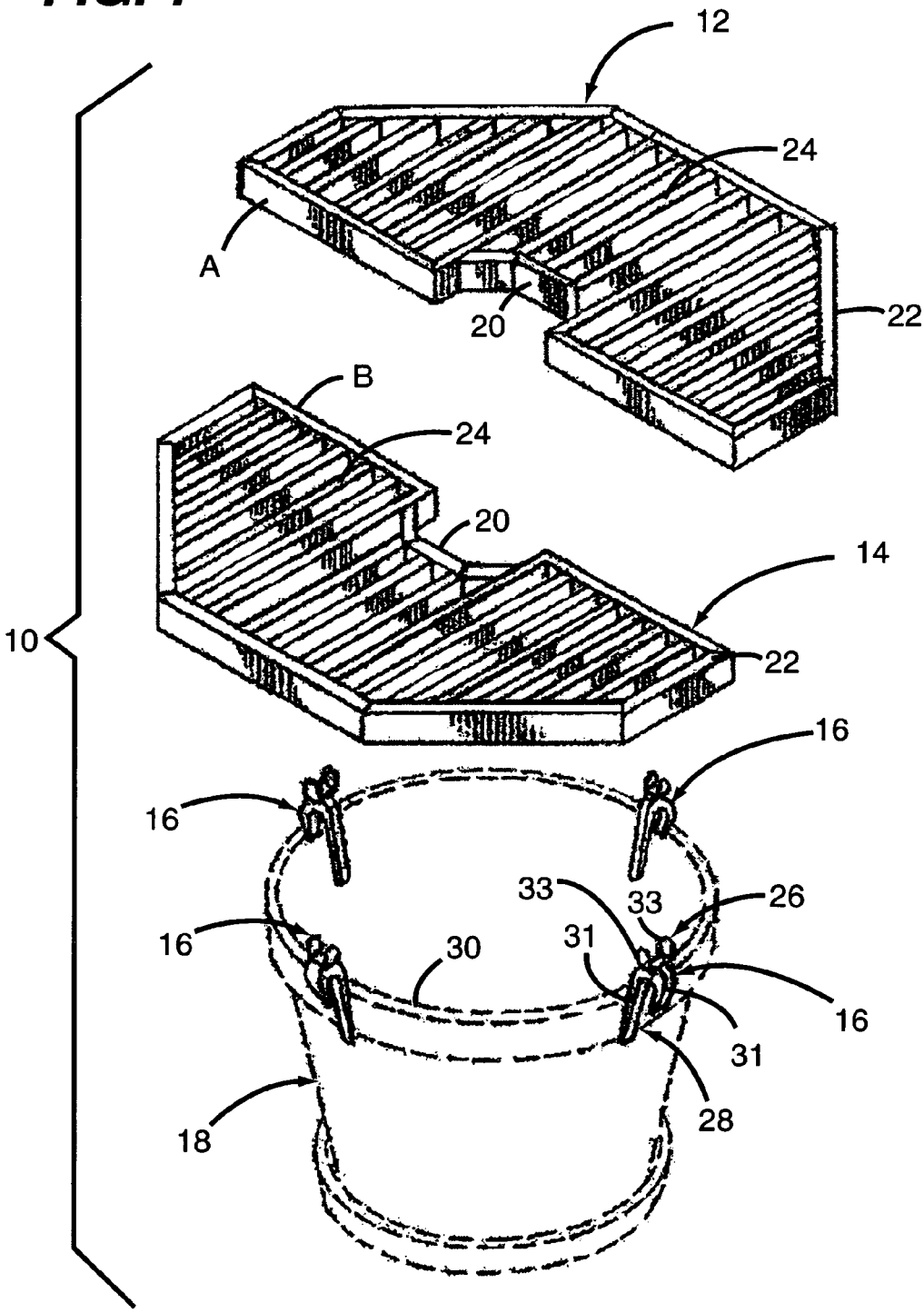
FIG. 1 is a partially exploded view of an embodiment of a tabletop system in accordance with the present invention.

As required, detailed embodiments of the present invention are disclosed herein; however, it is to be understood that the disclosed embodiments are merely exemplary of the invention that may be embodied in various and alternative forms. The figures are not necessarily to scale and some features may be exaggerated or minimized to show details of particular components. Therefore, specific structural and functional details disclosed herein are not to be interpreted as limiting, but merely as a basis for the claims and as a representative basis for teaching one skilled in the art to -variously employ the present invention.

Referring now to the figures, wherein like numbers refer to like parts throughout the several views, FIG. I depicts an embodiment of a tabletop system in accordance with the present invention (i.e., the tabletop system 10). The tabletop system 10 includes a first tabletop section 12, a second tabletop section 14, a plurality of mounting members 16 and a support base 13. As will be discussed below in greater detail, the first tabletop section 12, the second tabletop section 14, the plurality of mounting members 16 and the support base 18 are interconnectable for forming a space saving table in accordance with the present invention.

The first tabletop section 12 and the second tabletop section 14 are configured for being positioned in an abutted orientation at respective interface edges (A, B) for jointly forming a tabletop. The first tabletop section 12 and the second tabletop section 14, which are generally of identical construction, each include a cut-out portion 20 exposed at the respective interface edge (A, B) that form a correspondingly shaped opening in the tabletop when the first tabletop section 12 and the second tabletop section 14 are positioned in the abutted orientation.

The first tabletop section 12 and the second tabletop section 14 each include a frame 22 having a first protrusion surrounding a plurality of parallel slats 24. The slats 24 are spaced apart from each other such that a recess is formed between adjacent ones of the slats 24. Preferably, but not necessarily, generally equal spacing is provided between the slats 24. Opposing ends of each of the slats 24 are attached to the frame 22. In this manner, the frame 22 and the slats 24 of the respective tabletop section (12, 14) jointly define a tabletop support surface. The frame 22 of each tabletop section (12, 14) may be a single component or may be formed from a plurality of discrete components. It is disclosed herein that a solid piece of material may be used in place of all or some of the slats 24 such that a solid support surface is provided.

As depicted, the frame 22 of the first tabletop section 12 and the frame 22 of the second tabletop section 14 jointly form a hexagonal-shape tabletop. It is disclosed herein that the present invention is not limited to a tabletop having a particular shape. For example, the frame 22 of the first tabletop section 12 and the frame 22 of the second tabletop section 14 could be configured for forming a non-hexagonal shape table-top or a hexagonal shape tabletop other than hexagonal.

Figure 2:
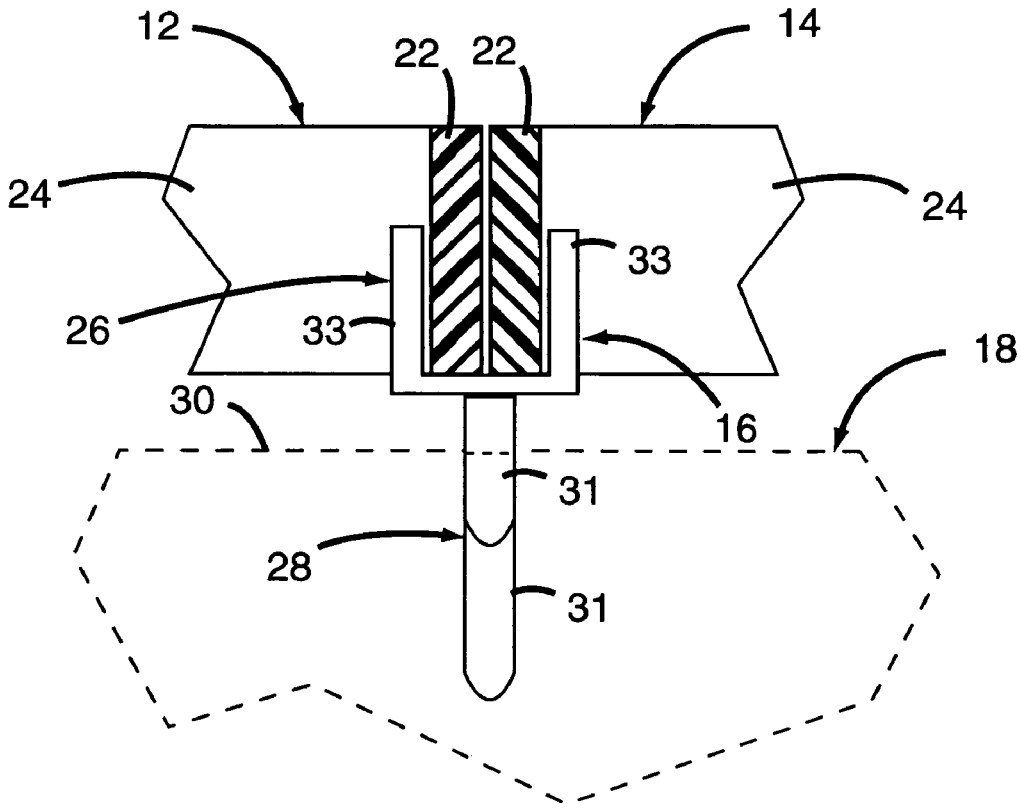
FIG. 2 is a fragmentary cross sectional view of the tabletop system of FIG. 1 in an installed arrangement and as viewed at an abutting portion of a tabletop of the tabletop system.
Figure 3:
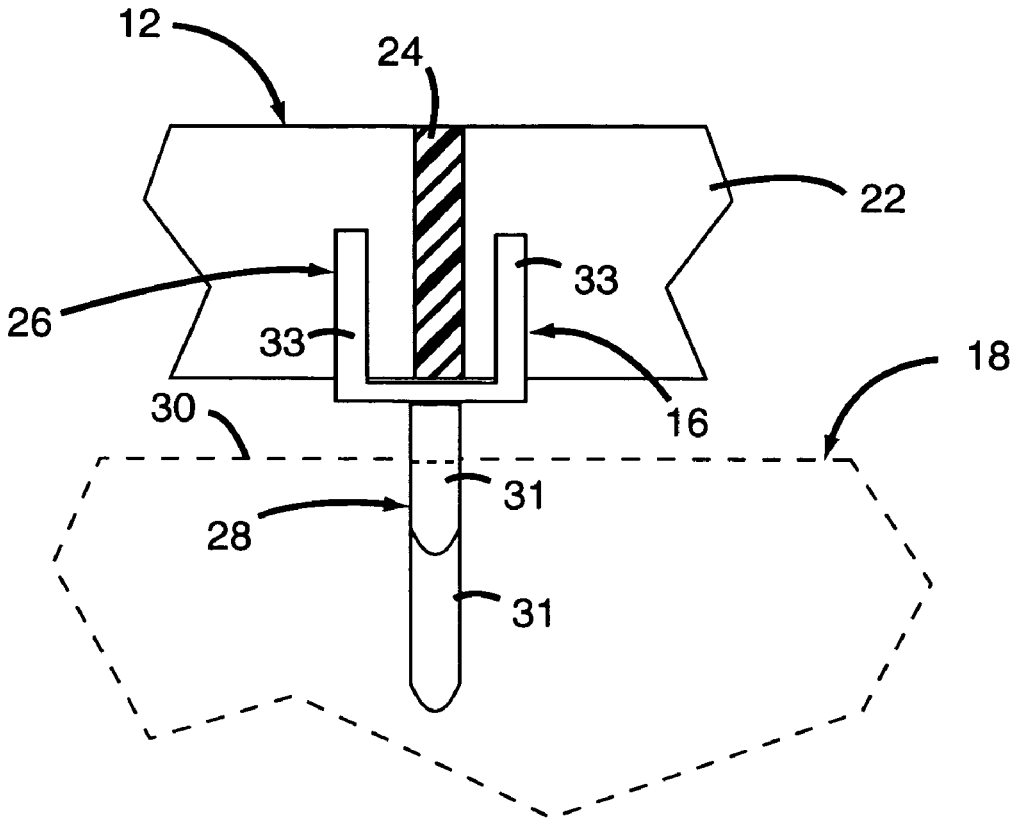
FIG. 3 is a fragmentary cross sectional view of the tabletop system of FIG. 1 in an installed arrangement and as viewed at a rib portion of the tabletop of the tabletop system.

Referring now to FIGS. 1-3, each one of the mounting members 16 includes a U-shape structure 26 and a hook-like structure 28 (i.e., having a U-shape portion). The U-shape structure 26 is an embodiment of a tabletop engaging portion of a mounting member in accordance with the present invention. The hook-like structure 28 is an embodiment of a support base engaging portion of a mounting member in accordance with the present invention. It is disclosed herein that, in view of the disclosures made herein, a skilled person will appreciate other embodiments of tabletop engaging portions in accordance with the present invention and support base engaging portion in accordance with the present invention. For example, the tabletop engaging portion may include or consist of a connector that securely connects to a respective portion of the tabletop sections (12, 14) through the use of discrete fasteners.

As depicted in FIGS. 1-3, the hook-like structure 28 of each one of the mounting members 16 is hooked over (i.e., engaged with) a rim portion 30 of the support base 18. The rim portion 30 is captured between spaced apart legs 31 of each hook-like structure 28. Four mounting members 16 are provided and are in approximately equally spaced relationship (i.e., 90-degree spacing). The tabletop sections (12,14) are positioned relative to the spaced apart mounting members 16 such that two of the mounting members in generally opposing positions (i.e., at the 10 o'clock and 4 o'clock positions) jointly engage the frame 22 of each tabletop section (12, 14) and such that the other two mounting members in generally opposing positions (e.g., at the 1 o'clock and 7 o'clock positions) are each engaged with a slat 24 of an adjacent one of the tabletop sections (12,14). More specifically, as depicted in FIG. 2, the tabletop sections (12, 14) are engaged with the mounting members 16 such that a portion of the frame 22 of each tabletop section (12, 14) at the respective interface edges (A, B) is captured between spaced apart legs 33 of the U-shape structure 26 of one of the mounting members 16 (e.g., in the 10 o'clock or 4 o'clock position), thereby serving to maintain the first tabletop section 12 in abutted relationship with the second tabletop section 14. As depicted in FIG. 3, the U-shape structure 26 of another one of the mounting members 16 (e.g., the 1-o'clock or 7 o'clock position) has a slat 24 of the adjacent frame (i.e., the frame 22 of the first tabletop section 12 depicted in FIG. 3) captured between the spaced part legs 33 thereof. In this manner, the intersection of frame 22 and the slats 24 of each tabletop section (12,14) each define a ridge (i.e., a second protrusion) engagable by the u-shape member 26 of the mounting members 16.

It is disclosed herein that, optionally, the U-shape structure 26 of the mounting members 16 may be sized and/or contoured to serve as biasing elements capable of gripping the frame 22 of each tabletop section (12, 14) at the respective interface edges (A, B) for maintaining the first tabletop section 12 in abutted relationship with the second tabletop section 14 and/or for gripping an engaged slat 24.

A distinguishing aspect of the present invention is combined relationship and configuration of the U-shape structure 26 of each mounting member 16 and the hook-like structure 28 of each mounting member 16. The U-shape structure 26 and the hook-like structure 28 are both embodiments of a saddle structure in accordance with the present invention (e.g., a tabletop engaging saddle structure and a support base engaging saddle structure, respectively). A saddle structure in accordance with the present invention is a structural member that has a retention channel (e.g., a U-shape channel) in which a portion of a structure (e.g., the support base 18) may reside. The retention channel is partially defines by spaced apart legs that may be of the same or different length. In accordance with the present invention, the retention channel of the tabletop engaging saddle structure longitudinally extends in a generally perpendicular direction with respect to the retention channel of the support body engaging saddle structure. Furthermore, retention channel of the tabletop engaging saddle structure and the retention channel of the support body engaging saddle structure are in back-to-back orientation such that the retention channel of the tabletop engaging saddle structure and the retention channel of the support body engaging saddle structure face opposite directions. This perpendicular orientation enables the mounting functionality discussed in reference to FIGS. 2 and 3. It is disclosed herein that, optionally, the tabletop engaging saddle structure is pivotally attached to the support body engaging saddle structure for enabling relative rotational movement, such as for enabling alignment with a respective portion of an engaged tabletop section.

It is disclosed herein that discrete fasteners such as, for example, screws, nails clips or the like may be used for more positively securing the first tabletop section 12 with the second tabletop section 14. In doing, so, reliance upon one or more of the mounting members to maintain the first tabletop section 12 in abutted relationship with the second tabletop section 14 is reduced if not eliminated. However, in this arrangement, the U-shape structures 26 still serve as a means for positioning the tabletop with respect to the support base 18.

In a preferred embodiment of the present invention, the support base 18 is a planter configured for having a plant potted therein. It is disclosed herein that, in other embodiments of the present invention, the support base is not a planter, but a container configured for having a planter positioned within a space therein or simply a structure having a rim portion suitably configured for being engaged by the hook-like structure 28 of each one of the mounting members 16.

Having described the figures relating to a preferred structure of a space saving table, the following discussion addresses optional, non-limiting embodiments in accordance with the present invention, which in general terms provide additional tabletops in spaces occupied previously by other objects and structures. Space saver tables in accordance with the present invention are particularly useful in congested areas of large cities where residences tend to be relatively small and have limited indoor and outdoor space for entertaining.

Even though space-limited, a typical residence will have ornamental structures of suitable height and sturdy construction to act as temporary bases for supporting tabletops. The combination of the support base, tabletop and mounting members in accordance with the present invention provides a table for special occasions when a residence becomes the location for a party or social event. Placement of tabletops on existing ornamental structures leaves more entertainment space available for guests.

Although patio areas of residences may be small, they are also the areas where plant containers are likely to be found. Addition to a small patio of at least a table and chairs along with plant-containing ornamental planters would not appear to leave much space for entertaining. It is possible, however, to create additional patio tables by adding tabletops over one or more planters, leaving suitable openings for growing plants. Ingenious application of tabletops to planters in patio areas increases the number of tables and places for conversation within the space originally available in the patio area.

Among other forms of plant containers, the commonly used plant pot provides a suitable support base for a tabletop that may be constructed in a variety of ways, involving high-quality, durable materials and different forms of functional components. The common plant pot has a roughly cylindrical shape including a circular rim upon which to lay a planar structure such as a tabletop. Preferably the tabletop is an assembly of parts comprising several tabletop sections to be placed over the plant pot clear of any foliage growing in soil contained by the plant pot. A preferred space saver patio table (SSPT) in accordance with the present invention includes a tabletop assembled from two tabletop sections laid flat across the top of a plant pot, allowing the rim of the pot to support the weight of the tabletop. The two tabletop sections are of substantially the same size and shape so that abutment between the tabletop sections coincides essentially with the diameter of the circular rim of the plant pot. Abutting portions of the tabletop sections have a profile to provide openings for plant stems and foliage to allow plant growth unimpeded by the assembled tabletop.

A space saver table in accordance with the present invention not only saves space, but also has additional benefits of providing occasional tables for special social events. The increased number of tables provides food stations and hot and cold beverage stations in more convenient places. This encourage self-service and more widespread interaction by guests attending the social event.

Attachment of a tabletop to a planter involves placing the first section on the planter then positioning the second section on the planter and releasably joining the sections together to form a tabletop suitable for releasable mounting on the planter using the rim of the planter to support the sections of the tabletop. Conversion of a planter, such as a flower pot, into a sturdy patio table makes maximum use of available space by providing additional table surfaces in cramped entertainment space. After use the tabletop may be disassembled and cleaned for storage.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes maybe made without departing from the spirit or scope of the present invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A tabletop system comprising:

a plurality of mounting members each having a tabletop engagement portion and a support base engagement portion, wherein a retention channel of the tabletop engagement portion faces a direction opposite and extends in a longitudinal direction perpendicular to a retention channel of the support base engagement position;

a split tabletop including a first tabletop section and a second tabletop section, wherein the first tabletop section and the second tabletop section each include a cut-out region at an interface edge thereof, a frame surrounding a plurality of parallel, spaced apart slats such that a recess is formed between adjacent ones of the slats, and wherein the first tabletop section and the second tabletop section each include a first protrusion created by the intersection of the slats with the frame; and wherein said first protrusion is removably mounted by the tabletop engagement portion of at least two of said mounting members when the interface edge of the first tabletop section is in abutted engagement with the interface edge of the second tabletop section and wherein the first tabletop section and the second tabletop section each include a second protrusion which is integral with the frame and extending downward from the intersection of slats; the second protrusion is engagable by the at least one of the mounting members.

2. The tabletop system of claim 1 wherein the table engagement portion and the support base engagement portion of each one of said mounting members are fixedly attached.

3. The tabletop system of claim 1 wherein the tabletop engagement structure and the support base engagement structure each include spaced apart legs defining the respective retention channel there between.

4. The tabletop system of claim 1 wherein:

the first tabletop section and the second tabletop section each include a frame;

the first protrusion is integral with the frame; and a width of the retention channel of the tab tabletop engaging portion of one of said retention members is at least twice as large as a width of the ridge defined by the frame, thereby enabling the ridge defined by the frame of said tabletop sections to be jointly engaged with the retention channel of said one of said retention members when the interface edge of the first tabletop section is in abutted engagement with the interface edge of the second tabletop section.

5. The tabletop system of claim 4 wherein the first tabletop section and the second tabletop section are essentially identical such that the cut-out region of the first tabletop section is aligned with the tabletop section of the second tabletop section when the interface edge of the first tabletop section is in abutted engagement with the interface edge of the second tabletop section.

6. The tabletop system of claim 5 wherein:

the first tabletop section and the second tabletop section each include a second protrusion; and the second protrusion is enable by the at least one of said mounting members.

7. The tabletop system of claim 6 wherein:

the table engagement portion and the support base engagement portion of each one of said mounting members are fixedly attached; and the tabletop engagement structure and the support base engagement structure each include spaced apart legs defining the respective retention channel there between.

8. A tabletop system, comprising:

a plurality of mounting members each having a first saddle structure and a second saddle structure fixedly attached to the first saddle structure, wherein a retention channel of the first saddle structure faces a direction opposite and extends in a longitudinal direction perpendicular to a retention channel of the second saddle member;

a split tabletop including a first tabletop section and a second tabletop section, wherein the first tabletop section and the second tabletop section each include a cut-out region at an interface edge thereof, wherein the first tabletop section and the second tabletop section each include a frame a having a ridge extending downward from the intersection of a plurality of slats which are connected to the frame, wherein each slat intersects with the frame in spaced apart relationship defining a respective ridge removably mounted by the first saddle section of at least two of said mounting members and wherein each one of said slats defines a respective ridge engagable by the first saddle structure of at least one of said mounting members.

9. The tabletop system of claim 8 wherein the tabletop engagement structure and the support base engagement structure each include spaced apart legs defining the respective retention channel there between.

10. The tabletop system of claim 8 wherein:

a width of the retention channel of the tabletop engaging portion of one of said retention members is at least twice as large as a width of the ridge defined by the frame, thereby enabling the ridge defined by the frame said tabletop sections to be jointly engaged within the retention channel of said one of said retention members when the interface edge of the first tabletop section is in abutted engagement with the interface edge of the second tabletop section.

11. The tabletop system of claim 10 wherein the first tabletop section and the second tabletop section are essentially identical such that the cut-out region of the first tabletop section is aligned with the tabletop section of the second tabletop section when the interface edge of the first tabletop section is in abutted engagement with the interface edge of the second tabletop section.

12. The tabletop system of claim 11 wherein the tabletop engagement structure and the support base engagement structure each include spaced apart legs defining the respective retention channel there between.

13. A table comprising:

a planter including a rim adjacent an upper portion thereof;

a plurality of mounting members each having a tabletop engagement portion and a planter engagement portion, wherein a retention channel of the tabletop engagement portion faces a direction opposite and extends in a longitudinal direction perpendicular to a retention channel of the planter engagement portion and wherein the planter engagement portion of each one of said mounting members is configured for having the rim of the planter engaged therein;

a split tabletop including a first tabletop section and a second tabletop section, wherein the first tabletop section and the second tabletop section each include a cut-out region at an interface edge thereof, when the interface edge of the first tabletop section is in abutted engagement with the interface edge of the second tabletop section thereby jointly forming a tabletop, wherein the cutout region of the first tabletop section is aligned with the cutout region of the second tabletop section thereby forming an opening in the tabletop section and wherein each tabletop section includes a frame which forms at least one ridge integral with the frame and adjacent the respective interface edge engaged within the retention channel of the tabletop engagement portion of one of said mounting members.

14. The table of claim 13 wherein the table engagement portion and the support base engagement portion of each one of said mounting members are fixedly attached.

15. The table of claim 13 wherein the tabletop engagement structure and the support base engagement structure each include spaced apart legs defining the respective retention channel there between.

16. The table of claim 15 wherein the table engagement portion and the support base engagement portion of each one of said mounting members are fixedly attached.

* * * * *